United States Patent [19]

Boberg

[11] Patent Number: 5,076,581

[45] Date of Patent: Dec. 31, 1991

[54] PROP FOR A HANDGRIP OF A GOLF CLUB

[76] Inventor: William J. Boberg, 15127 Woodland, Monroe, Mich. 48161

[21] Appl. No.: 562,035

[22] Filed: Oct. 9, 1990

[51] Int. Cl.[5] ..... A63B 69/36; A63B 55/10; A63B 57/00

[52] U.S. Cl. ..... 273/32 R; 273/162 R

[58] Field of Search ..... 273/162 R, 32 B, 194 R, 273/194 A, 194 B, 186 A, 183 D, 32 R

[56] References Cited

U.S. PATENT DOCUMENTS

| | | | |
|---|---|---|---|
| 1,507,632 | 9/1924 | Taylor | 273/32 B |
| 2,608,409 | 8/1952 | Pinkerton | 273/194 B |
| 3,203,700 | 8/1965 | Antonious | 273/32 B X |
| 3,647,220 | 3/1972 | Burkart et al. | 273/194 B |
| 4,027,886 | 6/1977 | Katsube | 273/186 A |
| 4,040,631 | 8/1977 | Flippin | 273/186 A |
| 4,991,839 | 2/1991 | Lumbattis | 273/162 R X |
| 5,012,872 | 5/1991 | Cohn | 273/32 B X |

*Primary Examiner*—George J. Marlo
*Attorney, Agent, or Firm*—Brooks & Kushman

[57] ABSTRACT

A prop for spacing a handgrip of a golf club from the ground such that when the golf club is laid thereupon, the handgrip remains dry and clean, is provided. The prop includes a body having a generally round aperture extending therethrough about a longitudinal axis with the aperture being sized and configured to retain the handgrip therewithin. The body also has spaced surfaces which form a slot opening radially outwardly from the aperture. The slot is sufficiently large to allow the shaft to radially enter, and sufficiently small to prevent the handgrip from exiting, the aperture. The prop may be radially inserted into the slot until the shaft is received within the aperture. The prop may then be slid longitudinally along the shaft and over the handgrip with the aperture being retainable about the handgrip. The prop has an peripheral portion configured such that when a golf club, with the prop located thereon, is placed on the ground in any angular configuration relative to the ground, the handgrip will remain radially spaced from the ground. Preferably, the configuration of the peripheral portion is generally circular.

4 Claims, 1 Drawing Sheet

PROP FOR A HANDGRIP OF A GOLF CLUB

BACKGROUND

1. Field of the Invention

The present invention relates to a golf accessory which keeps the club handle/grip dry when laying the club on wet or damp grass.

2. Description of the Prior Art

An accessory for keeping the handle of a club dry is depicted in U.S. Pat. No. 4,627,621 but only as a secondary function of that accessory.

DISCLOSURE OF INVENTION

The present invention is a golf accessory or prop which will serve as a tool to keep a golf club handgrip dry when placing the club on wet grass. In many instances, a golfer will carry two clubs in his hand when approaching a green. This invention will allow the golfer to simply slip the prop onto the club shaft, slide it up toward the handgrip, and without having to bend over, drop the club to the ground keeping the handgrip portion up off any damp or wet grass. The invention, in its preferred embodiment, is a disk with a slotted hole in the center to allow it to be slipped onto the club shaft and up and over the handgrip. The outer peripheral portion of the prop may be of any configuration which will provide sufficient radial spacing of the handgrip from the ground to keep the handgrip dry and clean. The preferred shape of the peripheral portion is circular.

BEST MODE FOR CARRYING OUT THE INVENTION

Figure 1:
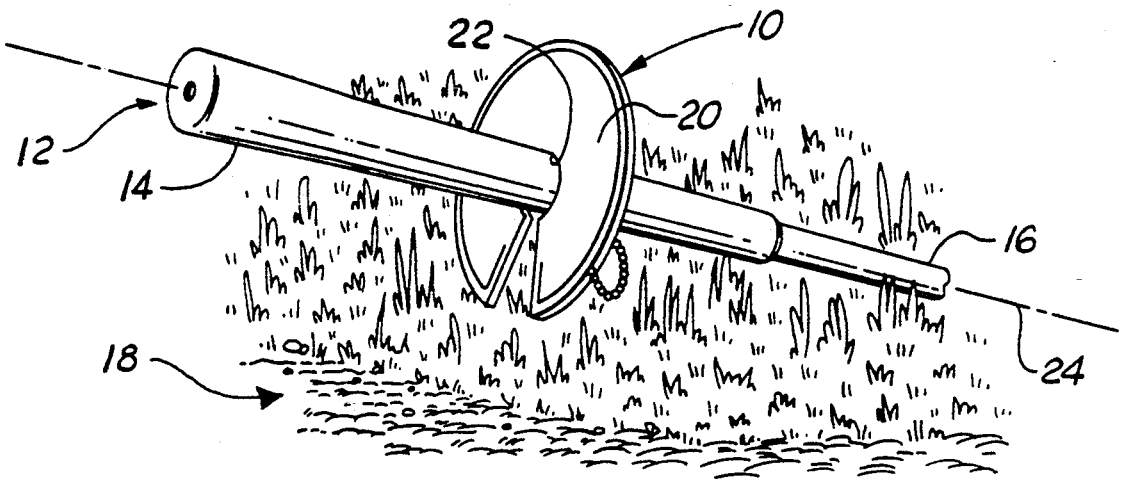
FIG. 1 is a perspective view of a prop, made in accordance with the present invention, cooperatively retained about a handgrip of a golf club to space the handgrip from the ground.

As seen in FIG. 1, prop 10 is cooperatively retainable upon a handgrip 14 of a golf club 12 which has a shaft 16, the prop 10 spacing the handgrip 14 from the ground 18.

Figure 3:
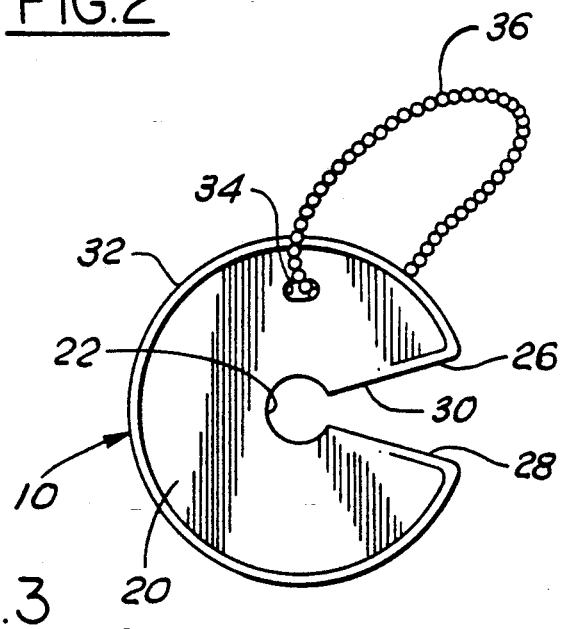
FIG. 3 is a plan view of the prop.

FIG. 3 illustrates a preferred embodiment of the prop 10. Prop 10 includes a body 20 having a generally round aperture 22 extending therethrough along a longitudinal axis 24. The aperture 22 is sized and configured to cooperatively retain the handgrip 14 therewithin. The body 20 further includes first and second spaced surfaces 26 and 28 which define a slot 30 opening radially outwardly from aperture 22.

The slot 30 is sized sufficiently large to allow the shaft 16 to radially enter therethrough and be received within the aperture 22. The slot 30 is also sufficiently small so as to prevent the larger handgrip 14 from exiting the aperture through slot 30.

The body 20 further includes a peripheral portion 32 configured such that when the prop 10 is mounted upon the handgrip 14, the golf club 12 may be placed on the ground 18, in any angular orientation with respect to the longitudinal axis 24, with the prop 10 radially spacing the handgrip 14 from the ground 18 a sufficient distance to keep the handgrip dry. Preferably, the peripheral portion 32 is circular with a diameter of 3.94 inches.

Figure 2:
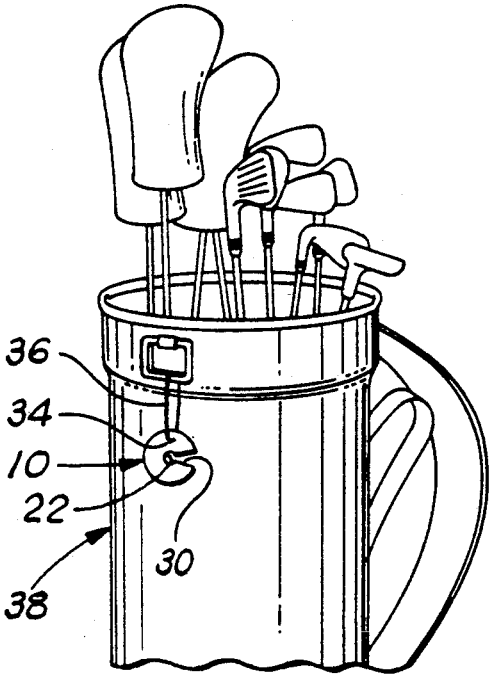
FIG. 2 shows a perspective view of a prop releasably secured to a golf bag.

FIG. 2 indicates that a second aperture 34 may be formed within body 20. Aperture 34 may receive a connecting device, such as a chain 36, to releasably secure prop 10 to a golf bag 38.

I claim:

1. A prop for spacing a handgrip of a golf club from the ground such that when the golf club is laid thereupon, the handgrip remains dry and clean, the golf club further including a shaft extending from the handgrip to a head, the prop comprising:

a generally flat; thin body having a generally round aperture extending therethrough about a central axis, the aperture being sized and configured to snuggly retain the handgrip of said golf club therein, the body further having spaced surfaces that define a slot opening outwardly from the aperture in a radial direction from the central axis, the slot being sized sufficiently large to allow the shaft of said golf club to radially enter, and sufficiently small to prevent the handgrip of said golf club from exiting, the aperture.

2. The prop of claim 1 having a peripheral portion configured such that when the prop is mounted upon the handgrip, the golf club may be placed on the ground, in any angular orientation with respect to the longitudinal axis, with the prop radially spacing the handgrip from the ground a sufficient distance to keep the handgrip dry.

3. The prop of claim 2 wherein the peripheral portion is generally circular.

4. A prop for spacing a handgrip of a golf club from the ground such that when the golf club is placed on the ground, the handgrip remains dry and clean, the golf club further including a shaft extending between a head and the handgrip, the prop comprising:

a generally C-shaped flat, thin body having a centrally located aperture extending therethrough about a central axis, an outer peripheral portion and a radially extending slot formed between the aperture and the outer peripheral portion, the aperture being generally round and sized to snuggingly retain the handgrip of said golf club therewithin, and the slot being sized sufficiently large to allow the shaft of said golf club to pass from the peripheral portion to the aperture and sufficiently small to prevent the handgrip of said golf club from passing therethrough, and the peripheral portion being sufficiently spaced from the aperture such that when the prop is mounted on the handgrip of said golf club at any angular relation relative to the central axis, the prop will sufficiently space the handgrip of said golf club from the ground when laid thereupon to prevent the handgrip of said golf club from becoming wet or dirty.

* * * * *